US010000301B2

(12) United States Patent
Williams

(10) Patent No.: US 10,000,301 B2
(45) Date of Patent: Jun. 19, 2018

(54) METHOD FOR DISPENSING MOIST SMOKELESS TOBACCO

(71) Applicant: ALTRIA CLIENT SERVICES LLC, Richmond, VA (US)

(72) Inventor: Dwight D. Williams, Powhatan, VA (US)

(73) Assignee: Altria Client Services LLC, Richmond, VA (US)

( * ) Notice: Subject to any disclaimer, the term of this patent is extended or adjusted under 35 U.S.C. 154(b) by 555 days.

(21) Appl. No.: 14/632,195

(22) Filed: Feb. 26, 2015

(65) Prior Publication Data

US 2015/0164140 A1 Jun. 18, 2015

Related U.S. Application Data

(62) Division of application No. 13/020,602, filed on Feb. 3, 2011, now Pat. No. 8,991,142.
(Continued)

(51) Int. Cl.
*B65B 29/00* (2006.01)
*B65B 63/02* (2006.01)
(Continued)

(52) U.S. Cl.
CPC ..... *B65B 29/00* (2013.01); *A24B 13/00* (2013.01); *A24F 23/02* (2013.01); *B65B 1/12* (2013.01);
(Continued)

(58) Field of Classification Search
CPC .... B65B 1/16; B65B 1/36; B65B 1/38; B65B 29/00; B65B 37/00; B65B 37/06;
(Continued)

(56) References Cited

U.S. PATENT DOCUMENTS 3,565,297 A 2/1971 Bladt et al.
4,607,479 A 8/1986 Linden
(Continued)

FOREIGN PATENT DOCUMENTS

DE 3335754 A1 4/1985
GB 817808 A * 8/1959 ..... B65B 1/04
(Continued)

OTHER PUBLICATIONS

EPO machine translation DE 3335754 A1, retrieved from espace.net, Feb. 12, 2018, 8 pages.*
(Continued)

*Primary Examiner* — Stephen F Gerrity
(74) *Attorney, Agent, or Firm* — Buchanan Ingersoll & Rooney PC

(57) ABSTRACT

An apparatus for accurately dosing moist smokeless tobacco includes a dosing assembly and a dosing air source. The dosing assembly defines a loading chamber and a dosing chamber for containing a quantity of moist smokeless tobacco material. The dosing assembly also includes a discharge opening communicating with the dosing chamber. The dosing air source communicates with the dosing chamber and is operable to deliver compressed air to the dosing assembly so as to move moist smokeless tobacco material from the dosing chamber to the discharge opening. A method of pouching moist smokeless tobacco includes placing a predetermined quantity of moist smokeless tobacco in a dosing chamber having a predetermined volume, and ejecting the predetermined quantity of moist smokeless tobacco to pouching apparatus using compressed air.

22 Claims, 5 Drawing Sheets

Related U.S. Application Data

(60) Provisional application No. 61/301,037, filed on Feb. 3, 2010.

(51) Int. Cl.

| | |
|---|---|
| ***B65B 1/12*** | (2006.01) |
| ***B65B 1/16*** | (2006.01) |
| ***B65B 37/10*** | (2006.01) |
| ***B65B 37/14*** | (2006.01) |
| ***B65B 37/20*** | (2006.01) |
| ***B65B 1/38*** | (2006.01) |
| ***A24B 13/00*** | (2006.01) |
| ***A24F 23/02*** | (2006.01) |
| *B65B 9/20* | (2012.01) |

(52) U.S. Cl.

CPC ..... *B65B 1/16* (2013.01); *B65B 1/38* (2013.01); *B65B 37/10* (2013.01); *B65B 37/14* (2013.01); *B65B 37/20* (2013.01); *B65B 63/02* (2013.01); *B65B 9/20* (2013.01)

(58) Field of Classification Search

CPC ..... B65B 37/08; B65B 37/10; B65B 37/14; B65B 37/16; B65B 37/20; B65B 63/02; B65B 39/00; A24B 13/00; A24F 23/02

USPC ..... 53/431, 436, 438, 439, 111 R, 111 RC, 53/122, 523, 529, 530; 131/111, 119; 222/273, 394, 413, 636

See application file for complete search history.

(56) References Cited

U.S. PATENT DOCUMENTS

| | | | | |
|---|---|---|---|---|
| 4,617,974 | A | 10/1986 | Focke et al. | |
| 4,696,146 | A * | 9/1987 | Esch et al. | B65B 29/00 53/202 |
| 4,703,765 | A | 11/1987 | Paules et al. | |
| 4,726,715 | A | 2/1988 | Steen et al. | |
| 4,751,948 | A | 6/1988 | Hertig et al. | |
| 4,844,296 | A | 7/1989 | Hayashi et al. | |
| 5,174,088 | A | 12/1992 | Focke et al. | |
| 5,309,958 | A * | 5/1994 | Ueda et al. | B65B 39/00 137/244 |
| 5,409,137 | A | 4/1995 | Bonomelli | |
| 6,044,624 | A | 4/2000 | Focke et al. | |
| 6,591,840 | B1 | 7/2003 | Grigutsch et al. | |
| 7,284,679 | B2 | 10/2007 | Zill et al. | |
| 7,980,251 | B2 | 7/2011 | Winterson et al. | |
| 8,074,428 | B2 | 12/2011 | Hoppe et al. | |
| 8,201,591 | B2 | 6/2012 | Monti | |
| 8,991,142 | B2 | 3/2015 | Williams | |
| 2008/0202532 | A1 | 8/2008 | Wygal | |
| 2010/0252056 | A1 | 10/2010 | Gruss et al. | |
| 2011/0239591 | A1 * | 10/2011 | Gruss et al. | B65B 29/00 53/438 |

FOREIGN PATENT DOCUMENTS

| | | | | |
|---|---|---|---|---|
| JP | 10-236435 | A | 9/1998 | |
| WO | WO 2008062301 | A1 * | 5/2008 | B65B 1/16 |
| WO | WO 2008/114133 | A1 | 9/2008 | |
| WO | WO 2008114122 | A2 * | 9/2008 | B65B 1/16 |
| WO | WO 2008/135469 | A1 | 11/2008 | |
| WO | WO 2009025604 | A1 | 2/2009 | |
| WO | WO 2009/047627 | A1 | 4/2009 | |

OTHER PUBLICATIONS

International Search Report and Written Opinion dated Apr. 4, 2011 for International Application No. PCT/US11/00195, 11 pages.

* cited by examiner

METHOD FOR DISPENSING MOIST SMOKELESS TOBACCO

CROSS REFERENCE TO RELATED APPLICATIONS

This application is a divisional application of U.S. application Ser. No. 13/020,602, filed Feb. 3, 2011 for APPARATUS FOR DISPENSING MOIST SMOKELESS TOBACCO which claims priority under 35 U.S.C. § 119(e) to U.S. Provisional Application No. 61/301,037, filed Feb. 3, 2010, the entire content of each is incorporated herein by reference.

WORKING ENVIRONMENT

This disclosure generally relates to method and apparatus for handling moist smokeless tobacco (MST) products. More particularly, the invention relates to method and apparatus for precision dispensing of MST.

Conventional methods for dosing and pouching MST include drying, pouching, rewetting and/or flavoring the MST, and then packaging the pouches for delivery to consumers. Typically, unless the MST is first dried, the MST cannot be accurately dosed or dispensed and then pouched on standard pouching apparatus machines because the high moisture content of the tobacco causes clumping and non-uniform delivery of tobacco to the pouches. After drying, the MST is typically pouched and rewetted. However, rewetting after pouching causes MST to clump, which causes non-uniform flavor delivery due to the higher density of the clumps within the pouch as compared to non-clumped portions of MST contained within the pouch. In addition, when the MST has been dried, the flavor and organoleptic characteristics may be undesirably changed when compared to the original loose, fibrous MST. Thus, it is desirable to pouch MST using a method and apparatus that can provide more uniform and accurate dosing of MST from a dosing cavity without the need for drying and/or rewetting steps.

Thus, a method and apparatus for accurately dosing MST that obviates the need for drying MST prior to pouching, substantially reduces or prevents the need for rewetting MST after pouching, and provides substantially accurate dosing of an oral tobacco pouch products has not yet been provided.

SUMMARY OF SELECTED ASPECTS

An apparatus for forming, filling and sealing oral tobacco pouch products preferably includes dispensing apparatus for accurately dosing moist smokeless tobacco. Preferably, the dispensing apparatus includes a dosing assembly or system and a dosing air source. Also preferably, the dosing assembly defines a loading chamber and a dosing chamber for containing a predetermined quantity of moist smokeless tobacco material and includes a discharge opening communicating with the dosing chamber. Moreover, the dosing air source communicates with the dosing chamber and is operable to deliver compressed air to the dosing assembly so as to move moist smokeless tobacco material from the dosing cavity to the discharge opening.

In the preferred embodiment, the apparatus can also include a hopper for containing moist smokeless tobacco prior to delivery of the moist smokeless tobacco to the dosing assembly. Tobacco feed system may also be provided between the hopper and the dosing assembly which includes a dual screw feeder and a tobacco feed drive for driving the dual screw feeder. Preferably, the dual screw feeder conveys moist smokeless tobacco from the hopper to the dosing assembly. Also preferably, the apparatus includes a dosing tube for communicating with the discharge opening and for delivering moist smokeless tobacco from the dosing apparatus to the pouching apparatus. Further, the apparatus may include a controller for controlling the apparatus and sequencing the various components thereof. In the preferred embodiment, the apparatus can also include an atomized water source for supplying water to the cavity and/or dosing tube between dosing operations so as to remove residual MST contained therein.

Also in the preferred embodiment, the assembly includes a movable element operable to move between an open loading position and a closed dosing position. When the movable element is in the open loading position a loading chamber is defined therein. When the movable element is in the closed dosing position, a dosing chamber is defined within the apparatus. When the movable element is in the open loading position, MST can be loaded into the loading chamber. When the movable element is in the closed dosing position, newly introduced MST in the loading chamber is urged into the confines of a dosing chamber. A pulse of compressed air then discharges the MST through a discharge opening leading to the dosing tube.

In one preferred embodiment, the movable element includes a rotary dosing cam. Preferably, the rotary dosing cam or slide is adapted to be moved between an open loading position and a closed dosing position. When the rotary dosing cam rotates to the open loading position, a loading chamber is defined in the apparatus and MST can be loaded into the loading chamber. Preferably, the tobacco feed system delivers MST to the loading chamber. As the rotary dosing cam rotates to the closed dosing position, MST contained within the loading chamber is compacted to a generally cylindrical form within the dosing chamber and held in a position generally aligned with the dosing tube. Preferably, the dosing air source provides compressed air to an air inlet directly above the generally cylindrical shaped MST so as to force substantially all of the predetermined quantity of MST from the dosing chamber and into the dosing tube. The blast of air helps to ensure delivery of substantially all of the predetermined quantity of MST to the pouching apparatus.

In another embodiment, the movable element includes a reciprocable slide component. The reciprocable slide has a generally semi-circular recess on its inner face, and cooperates with a stationary piece which has a complementary generally semi-circular recess. When the reciprocable slide and the stationary piece are brought together at the closed dosing position, a dosing chamber is defined within the generally semi-circular recesses of the reciprocable plug and the stationary piece. Preferably, the assembly also includes an air cylinder connected to the reciprocable slide and operable to move the reciprocable slide. When the reciprocable slide is in the open position, a loading chamber is defined within the linear dosing assembly and a predetermined quantity of MST can be received in the loading chamber from the tobacco feed system. When in the closed position, the reciprocable slide prevents further loading of the loading chamber. As the reciprocable slide closes, the loading chamber is compressed and MST is formed into a generally cylindrical plug within the dosing chamber located within the linear dosing assembly. Preferably, dosing chamber is adjacent to and aligned with the dosing tube. Also preferably, the dosing air source provides compressed air to an air inlet adjacent the dosing chamber so as to force substantially all of the predetermined quantity of MST from the dosing chamber and into the dosing tube.

In a preferred embodiment, a method of pouching moist smokeless tobacco includes the steps of placing a predetermined quantity of moist smokeless tobacco in a dosing chamber having a predetermined volume, and ejecting the predetermined quantity of moist smokeless tobacco to pouching apparatus using compressed air. The method can also include the steps of conveying the predetermined quantity of moist smokeless tobacco using a tobacco feed drive, applying atomized water subsequent to the ejecting step and subsequent placing step, delivering the predetermined quantity of moist smokeless tobacco to pouching apparatus through a dosing tube, placing the predetermined quantity of moist smokeless tobacco in a pouch, and/or sealing the pouch to contain the moist smokeless tobacco therein and form an oral tobacco pouch product.

BRIEF DESCRIPTION OF THE DRAWINGS

The invention will be further described, by way of example only, with reference to the accompanying drawings, wherein like reference numerals are applied to like elements and wherein.

DETAILED DESCRIPTION

A method and apparatus for uniformly pouching high OV (oven volatiles) tobacco is provided herein that is capable of repeatedly and consistently feeding predetermined amount of high OV tobacco, such as moist smokeless tobacco (MST) having a moisture content of at least about 50% or more and/or doing the same with tobacco that is tacky and difficult to feed with conventional devices, because of the presence of elevated levels of humectants, flavors, or other additives in the tobacco. Tackiness in some tobaccos can arise and create feeding difficulties at moisture contents of about 30% or greater. Also preferably, the apparatus includes a feed system for delivering a substantially accurate quantity of moist smokeless tobacco to individual pouch wrappers in the course of manufacture of pouched tobacco products.

As used herein, the term "moist smokeless tobacco" ("MST") refers to loose, fibrous leaf tobacco that is optionally fermented and/or optionally flavored. Preferably, the MST includes a blend of tobaccos that are cut, optionally fermented, optionally pasteurized, and/or optionally flavored. With practice of teachings herein, the MST can be fed into pouches without being dried and/or rewetted so as to substantially avoid altering the flavor and/or organoleptic properties of the MST after processing and placement in pouched products for oral use. Preferably, the MST is in the form of fine cut, loose tobacco fibers having short strands ranging in length from about 0.2 mm to about 15 mm (e.g., about 0.2 mm to about 12 mm, about 0.5 mm to about 10 mm, about 1.0 mm to about 8 mm, about 2.0 mm to about 6.0 mm, or about 3.0 mm to about 5.0 mm) and having a width of about 0.2 mm to about 2.5 mm (e.g., about 0.2 mm to about 2.0 mm, about 0.5 mm to about 1.5 mm, or about 0.75 mm to about 1.0 mm).

As used herein, the term "fermented" refers to the transformation of a material (such as tobacco) using one or more microorganisms, such as bacteria.

As used herein, the value of "oven volatiles" or "OV" is determined by placing a weighed sample of moist botanical material in an air-circulating oven and maintaining the sample in the oven, at a temperature of 100° C., for a period of three hours, after which the sample is again weighed. The difference in the two weight values expressed as a percentage of the original weight is defined as "oven volatiles" or "OV." Oven volatiles include water and anything that boils at a temperature of less than about 100° C.

Figure 1A:
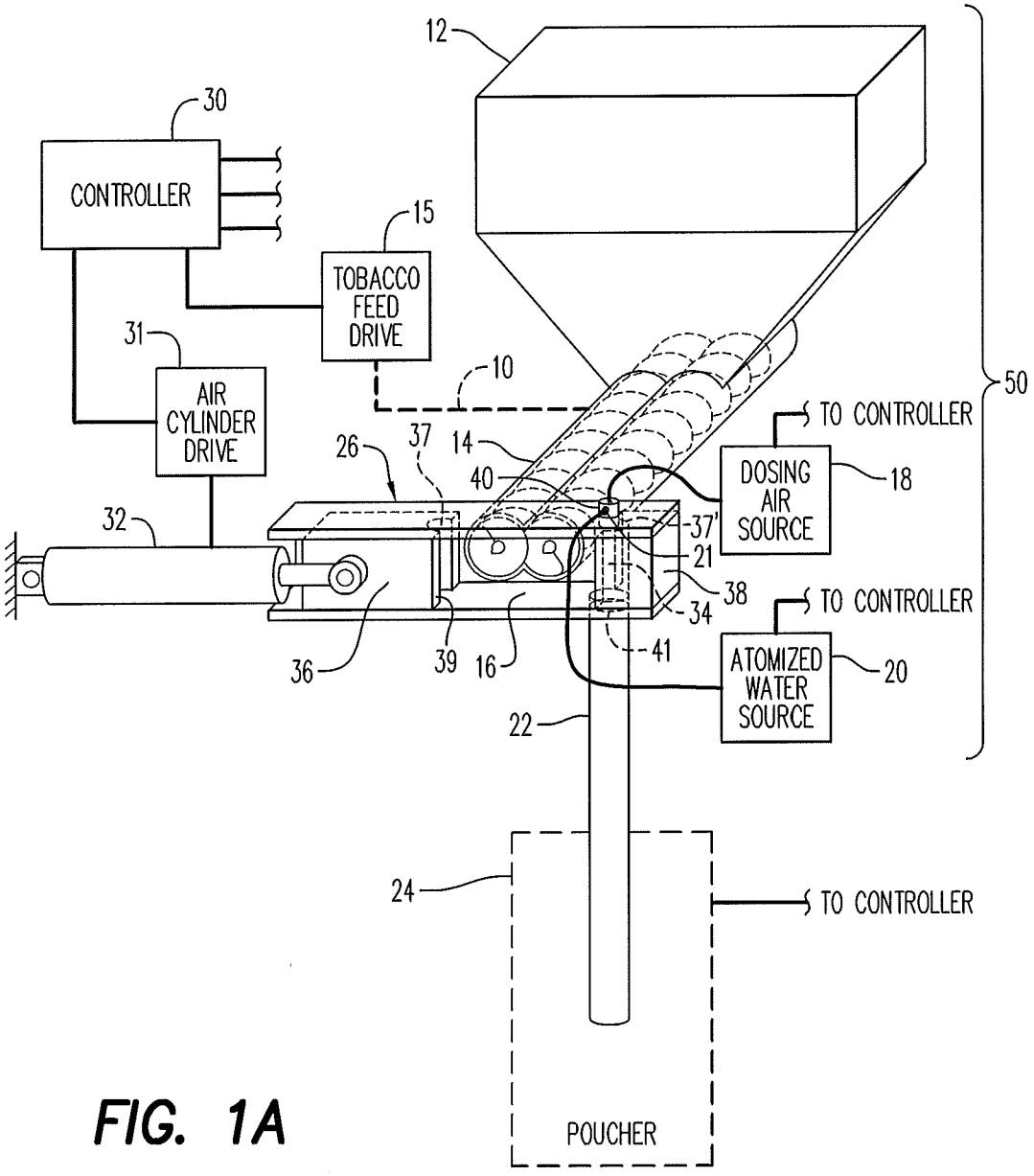
FIG. 1A is a schematic illustration of a first embodiment of a pouching apparatus including a feed system having a reciprocable dosing actuation.

As shown in FIG. 1A, in a preferred embodiment, an apparatus for pouching moist smokeless tobacco includes a feed system 50 for accurately, consistently, and repetitively dosing or dispensing a predetermined quantity of MST to a pouching apparatus 24, such as the pouching apparatus manufactured and sold by, for example, Ropak Manufacturing Company, Inc. of Decatur, Ala. and Merz Verpackungsmaschinen GmbH, Lich, Germany. In the preferred embodiment, the pouching apparatus 24 forms individual pouches, places a predetermined quantity of MST in each pouch, and forms at least one seal to contain the MST within the pouch so as to form an oral tobacco pouch product.

In the preferred embodiment, the apparatus includes a feed system 50 that is designed to accurately dose MST so that a predetermined amount of MST is delivered to the pouching apparatus for placement a pouch. Preferably, the feed system 50 includes a hopper 12 for containing or holding a supply of MST prior to conveyance through the feed system 50. Also preferably, the hopper 12 supplies MST to a tobacco feed system 10 which may include a dual screw feeder 14, and a tobacco feed drive 15. In the preferred embodiment, the tobacco feed drive 15 is connected to a controller 30, which operates the tobacco feed drive 15 and in turn, the dual screw feeder 14. Also preferably, the controller 30 and the tobacco feed drive 15 operates the dual screw feeder 14 incrementally (for example, one and a half turns each time) so that a predetermined quantity of MST is transported from the hopper 12 to a dosing assembly 26.

In the preferred embodiment, the dosing assembly 26 defines a loading chamber 16 for containing a predetermined quantity of MST, a dosing chamber 34, and a discharge opening 41 communicating with the dosing chamber 34. Preferably, the apparatus also includes a dosing air source 18 communicating with the dosing chamber 34 and operable to deliver compressed air to the dosing chamber 34 so as to move MST from the dosing chamber 34 through the discharge opening 41 and down a dosing tube 22 to the poucher 24.

Figure 1B:
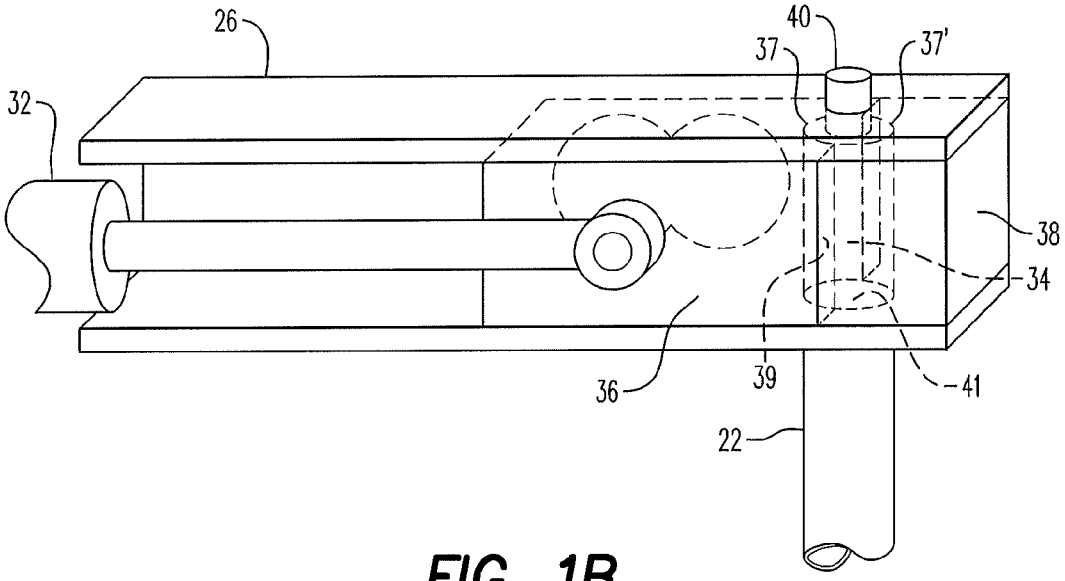
FIG. 1B is a perspective view of the first embodiment of FIG. 1A in a closed position

In one preferred embodiment, the dosing assembly 26 includes a movable element including a reciprocable slide 36 and an air cylinder 32 that is operatively connected with the reciprocable slide 36 and operable to move the reciprocable slide 36. Preferably, the reciprocable slide 36 has a generally semi-circular recess or groove 37 on an inner face 39 thereof. Also preferably, the reciprocable slide 36 cooperates with a stationary piece 38 which has a complementary, generally semi-circular recess or groove 37'. Referring now to FIG. 1B, when the reciprocable slide 36 and the stationary piece 38 are brought together, they define the dosing chamber 34 along recesses 37 and 37'. Moreover, the dosing chamber 34 is preferably aligned with and of the same cross-sectional shape as dosing tube 22 (e.g., cylindrical). Preferably, the dosing assembly 26 is configured to repetitively dose a predetermined quantity of MST. In the preferred embodiment, the linear dosing assembly 26 may extend substantially horizontally within the feed system 50 (as shown in FIG. 1A). In an alternative embodiment, the linear dosing assembly 26 may be positioned substantially vertically within the feed system 50 (not shown).

Preferably, the action of the air cylinder 32 causes the reciprocable slide 36 to move between an open loading position (as shown in FIG. 1A) and a closed dosing position (as shown in FIG. 1B). When the reciprocable slide 36 is in the open position, a loading chamber 16 is defined within the linear dosing assembly 26, which communicates with the discharge end of the screw feeder 14 through a port. Thus, upon its actuation, the screw feeder 14 delivers a predetermined quantity of MST through the port to the loading chamber 16 while the reciprocable slide 36 is at the open loading position. Preferably, MST fills at least a portion of the loading chamber 16. When the reciprocable slide 36 moves to the closed position, the port of the screw feeder 14 is blocked and additional MST cannot enter the loading chamber 16 from the screw feeder 14. Moreover, as the reciprocable slide 36 moves to the closed position and is positioned adjacent the stationary piece 38, the predetermined amount of MST in the loading chamber 16 is compressed or compacted into a generally cylindrical form within the dosing chamber 34 and remains suspended within the dosing chamber 34 awaiting discharge therefrom upon actuation of the dosing air source 18. In the preferred embodiment, the dosing chamber 34 is formed partially by a wall of the stationary portion and partially by the inner face 39 of the reciprocable slide 36. The generally cylindrical dosing chamber 34 is generally aligned with, lies adjacent to, and communicates with an air inlet 40 at one end and a dosing tube 22 at the other end. More preferably, the dosing chamber 34 lies below the air inlet 40 and above the dosing tube 22. Preferably, a discharge opening 41 is defined adjacent the upper end portion of the dosing tube 22 and the dosing chamber 34. Also preferably, the predetermined quantity of MST exits the dosing chamber 34 via the discharge opening 41.

In the preferred embodiment, the air inlet 40 communicates with a dosing air source 18. Preferably, the dosing air source 18 delivers compressed air to the air inlet 40. The air is then blown through the air inlet 40, and towards the cylindrical plug so as to push or force the MST through the discharge opening 41 and into the dosing tube 22. Preferably, the moist smokeless tobacco then passes through the dosing tube 22 to the pouching apparatus 24 where the moist smokeless tobacco is positioned between layers of a porous web material. Because MST can be sticky, the blast or pulse of compressed air helps to push substantially all of the predetermined quantity of MST that was situated in dosing chamber 34 to the dosing tube 22 so that substantially all of the predetermined quantity of MST is delivered to the pouching apparatus for placement in a pouch wrapper.

Optionally, between dosing operations, water from an atomized water source 20, located downstream of the air inlet 40 but upstream of the dosing chamber 34, can be supplied to the dosing assembly 26 and/or the dosing tube 22 via a water inlet 21 to help remove any residual MST after the blast or pulse of air moved the MST froms the dosing chamber 34 and down the dosing tube 22. Preferably, the atomized water spray may then pass through the dosing tube 22 and may be included in the oral tobacco pouch product so as to help maintain desired moisture content of the MST. Preferably, the quantity of water is small so as not to substantially impact the moisture content of the tobacco that has been placed in the pouch. In the preferred embodiment, about 0.5 milliliters (ml) to about 1.5 ml of water is sprayed between each dosing operation. For example, about 1 ml of water can be sprayed into the linear dosing assembly 26 through the water inlet 21 to rinse the linear dosing assembly 26 and/or the dosing tube 22. Thus, any residual MST is pushed or advanced into the dosing tube 22 for delivery to the pouching apparatus 24. Preferably, the atomized water source 20 is connected to and operated by the controller 30, which controls if and when water is supplied to the linear dosing assembly 26.

Also in the preferred embodiment, the controller 30 functions to operate the various components of the feed system 50 including the tobacco feed drive 14, dosing air source 18, atomized water source 20, and air cylinder drive 31, as described above. Also preferably, the controller 30 communicates with the pouching apparatus 24 so that doses of MST are delivered to the pouching apparatus 24 at the appropriate time. In the preferred embodiment, the controller 30 sequentially controls the operations of the various components to drive MST through the feed system 50 and to the pouching apparatus 24.

In the preferred embodiment, the components of the feed system 50 and/or pouching apparatus 24 are formed of stainless steel. Alternatively, the components of the feed system 50 and/or pouching apparatus 24 be formed of other materials selected from the group consisting of metals, metal alloys, plastic, and combinations thereof.

Figure 2:
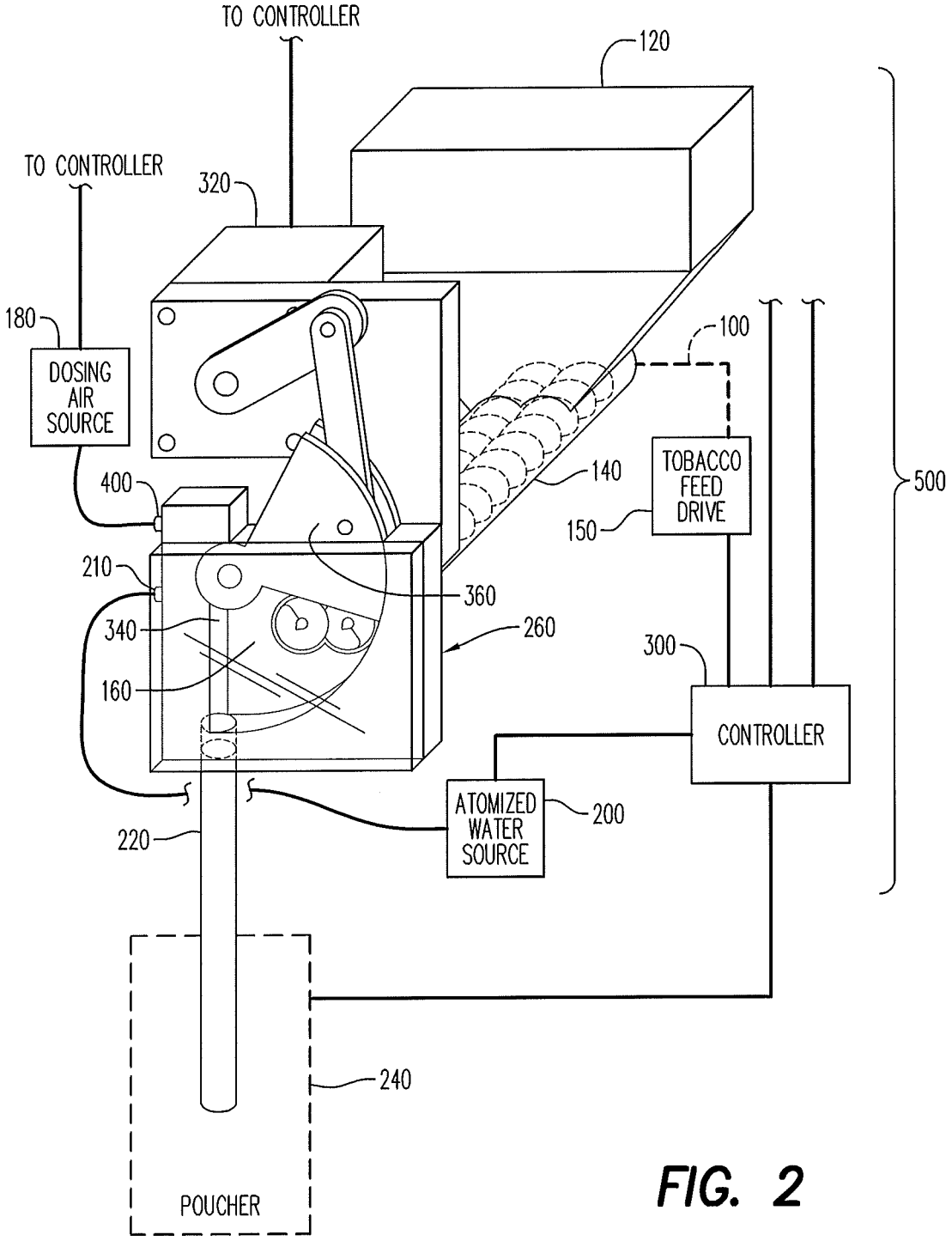
FIG. 2 is a schematic illustration of a second embodiment of a pouching apparatus including a feed system having a rotary dosing actuation.

In a second embodiment, as shown in FIG. 2, an apparatus for pouching MST includes a feed system 500 for accurately and repetitively dosing or dispensing a predetermined quantity of MST and providing the predetermined quantity of MST to a pouching apparatus (as described above) where a predetermined quantity of MST is placed in each pouch wrapper so as to form tobacco pouch products for oral use.

In the preferred embodiment, the apparatus includes a feed system 500 that is designed to accurately dose or dispense MST so that an accurate amount of MST is delivered to the pouching apparatus for placement a pouch. Preferably, the feed system 500 includes a hopper 120 for containing or holding MST prior to conveyance through the feed system 500. Also preferably, the hopper 120 supplies MST to a tobacco feed system 100 which may include a dual screw feeder 140 and a tobacco feed drive 150. In the preferred embodiment, the tobacco feed drive 150 is connected to a controller 300, which operates the tobacco feed drive 150, and in turn, incrementally operates the dual screw feeder 140 (for example, one and a half turns each time). Also preferably, the tobacco feed drive operates the dual screw feeder 140 so that MST is transported from the hopper 120 to a dosing assembly 260.

In one preferred embodiment, the dosing assembly 260 is a rotary dosing assembly 260. Preferably, the rotary dosing assembly 260 is configured to substantially accurately dose or dispense a predetermined quantity of MST. In the preferred embodiment, the rotary dosing assembly 260 includes a movable element which partially defines a loading chamber 160 when in a retracted, open, loading position as shown. Also preferably, the loading chamber 160 communicates with the discharge end of the screw feeder 140. Moreover, the movable element includes a rotary dosing cam 360 that is adapted to be moved between the open, loading position and a closed dosing position. Preferably, the loading chamber 160 is filled with the predetermined quantity of MST as the MST is fed to the rotary dosing assembly 260 by the dual screw feeder 140. As the rotary dosing cam 360 moves to the closed dosing position, the MST is moved into the dosing chamber 340 wherein it is suspended in a compressed or compacted state. Preferably, the dosing chamber 340 is disposed between an air inlet 400 and a dosing tube 220. More preferably, the dosing chamber 340 lies below the air inlet 400 and above the dosing tube 220. A discharge opening 410 of the loading chamber 160 is defined at the upper end of the dosing tube 220. In use, MST passes from the dosing chamber 340, through the discharge opening 410, and into the dosing tube 220.

In the preferred embodiment, the air inlet 400 communicates with a dosing air source 180. Preferably, the dosing air source 180 delivers compressed air to the air inlet 400. The air is then blown through the air inlet 400 and towards the dosing chamber 340 so as to force or push the MST through the discharge opening 410 and into the dosing tube 220. Preferably, the moist smokeless tobacco then passes through the dosing tube 220 and to a pouching apparatus 240 where the moist smokeless tobacco is positioned between layers of a porous web material. Because MST can be sticky, the blast or pulse of compressed air helps to push essentially all of the predetermined quantity of MST that entered the dosing chamber 340 through the discharge opening 410 and to the dosing tube 220 so that substantially all of the predetermined quantity of MST is delivered to the pouching apparatus for placement in a pouch wrapper.

Figure 3A:
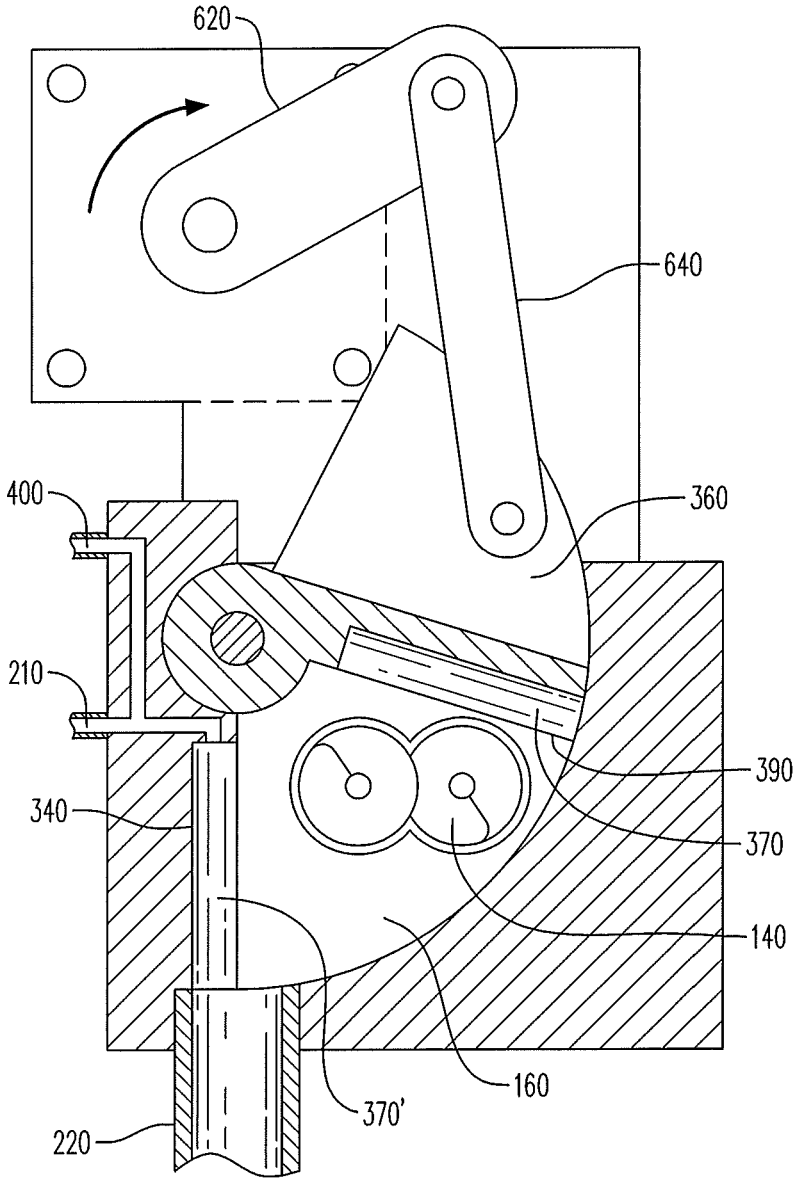
FIG. 3A is a partial cross-sectional view of the second embodiment of FIG. 2 in an open position.
Figure 3B:
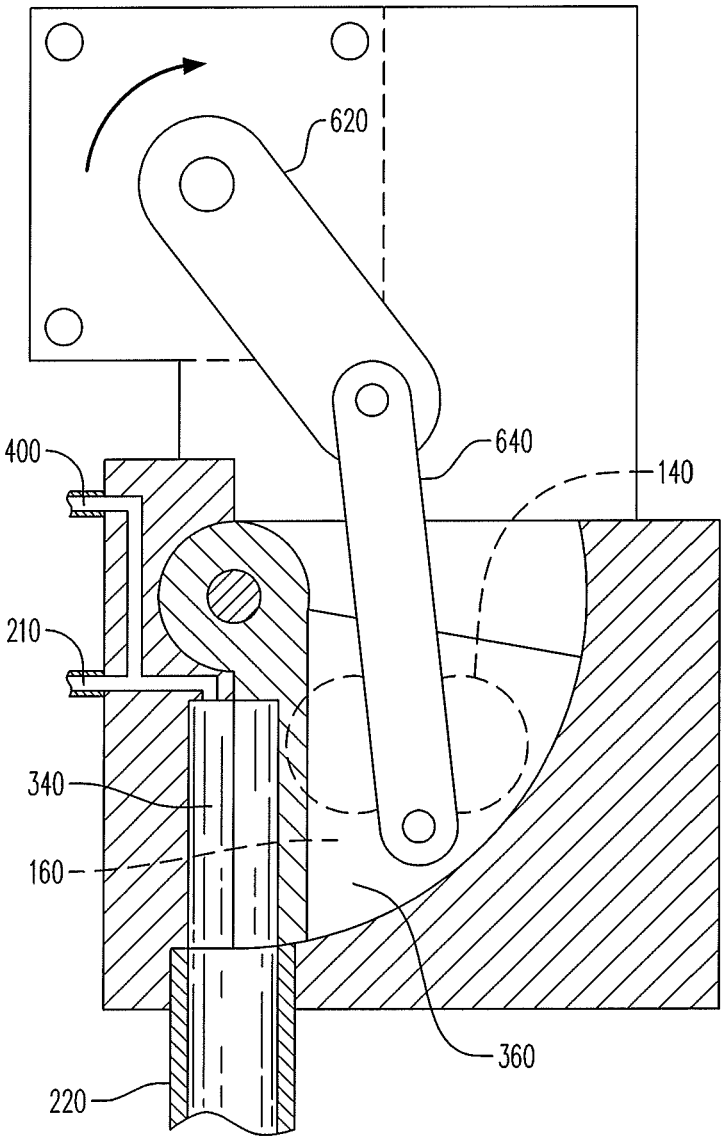
FIG. 3B is a partial cross-sectional view of the second embodiment of FIG. 2 in a closed position.

As shown in FIG. 3A and FIG. 3B, in the preferred embodiment, the movable element of the rotary dosing assembly 260 includes the rotary dosing cam 360. Preferably, a first arm 620 and a second arm 640 act to rotate the rotary dosing cam 360 between the open loading position and the closed dosing position. When in the open loading position, the loading chamber 160 is defined within the assembly 260. In use, when the rotary dosing cam (or slide) 360 is in the open loading position, as shown in FIG. 3A, a predetermined quantity of MST can be loaded into the loading chamber 160 defined therein. Preferably, a predetermined quantity of MST is delivered to the loading chamber 160 by the dual screw feeder 140. Once the rotary dosing cam 360 is rotated to the closed dosing position, as shown in FIG. 3B, the predetermined quantity of MST contained in the loading chamber 160 is compressed into a generally cylindrical plug at the dosing chamber 340 and is suspended (retained) over the dosing tube 220. A jet of compressed air is then blown through an air inlet 400 to blow essentially all of the predetermined quantity of MST contained in the dosing chamber 340 therefrom. The predetermined quantity of MST then moves through the discharge opening 410 (shown in FIG. 2) and into the dosing tube 220 for delivery to the pouching apparatus 240.

Optionally, between dosing operations, water from an atomized water source 200, as shown in FIG. 2, can be supplied to the rotary dosing assembly 260 and/or the dosing tube 220 via a water inlet 210. The water helps remove any residual MST after the blast or pulse of air has moved the MST through the discharge opening 410 and to the dosing tube 220. Preferably, the atomized water spray may then pass through the dosing tube 220 and may be included in oral tobacco pouch products so as to help maintain the generally high moisture content of the MST. In the preferred embodiment, about 0.5 ml to about 1.5 ml of water is sprayed between each dosing operation. Preferably, any residual MST is pushed into the dosing tube 220 for delivery to the pouching apparatus 240. Also preferably, the atomized water source 200 is connected to the controller 300, which controls if and when water is supplied to the rotary dosing assembly 260.

Also in the preferred embodiment, the controller 300 functions to operate the various components of the feed system 500 including the tobacco feed drive 140, dosing air source 180, atomized water source 200, and air cylinder drive 310, as described above. Also preferably, the controller 300 is connected to and operates the pouching apparatus 240. In the preferred embodiment, the controller 300 sequentially controls the operations of the various components to drive MST through the feed system 500 and to the pouching apparatus 240.

In the preferred embodiment, the components of the feed system 500 and/or pouching apparatus 240 are formed of stainless steel. Alternatively, the components of the feed system 500 and/or pouching apparatus 240 be formed of other materials selected from the group consisting of metals, metal alloys, plastic, and combinations thereof.

In a preferred embodiment, a method of pouching moist smokeless tobacco material includes placing a predetermined quantity of moist smokeless tobacco in a dosing chamber, and ejecting the predetermined quantity of moist smokeless tobacco using compressed air. Preferably, the method also includes conveying the predetermined quantity of moist smokeless tobacco using a tobacco feed drive system. Optionally, the method can include spraying atomized water into the dosing chamber between dosing operations. In the preferred embodiment, the method can also include delivering the predetermined quantity of moist smokeless tobacco to a pouching apparatus using a dosing tube. Moreover, the method can include placing the predetermined quantity of moist smokeless tobacco in a pouch and sealing the pouch to contain the predetermined quantity of moist smokeless tobacco therein and form a tobacco pouch product for oral use.

It is to be realized that the teachings herein can be applied to other organic or inorganic materials that are tacky and otherwise difficult to feed in a consistent, repetitive manner. The teachings may also be applied to the feeding of tacky materials to processing machines other than pouching machines as described herein.

As used herein, the term "about" when used in conjunction with a stated numerical value or range denotes somewhat more or somewhat less than the stated value or range, to within a range of ±10% of that stated.

In this specification the words "generally" and "substantially" are sometimes used with respect to terms. When used with geometric terms, the words "generally" and "substantially" are intended to encompass not only features which meet the strict definitions but also features which fairly approximate the strict definitions.

While the foregoing describes in detail a preferred apparatus and methods for pouching moist smokeless tobacco with reference to a specific embodiment thereof, it will be apparent to one skilled in the art that various changes and modifications may be made to apparatus and equivalent methods may be employed, which do not materially depart from the spirit and scope of the foregoing description. Accordingly, all such changes, modifications, and equivalents that fall within the spirit and scope of the appended claims are intended to be encompassed thereby.

I claim:

1. A method of pouching moist smokeless tobacco comprising:

placing a predetermined quantity of moist smokeless tobacco in a loading chamber and compacting the placed predetermined quantity into a cylindrical dosing chamber formed by moving a movable element from a retracted position which does not block a port through which the predetermined quantity passes into the loading chamber to a closed position at which the port is blocked by the movable element and a discharge opening of the dosing chamber is aligned with a dosing tube and the dosing chamber is in fluid communication with a source of compressed air; and ejecting the predetermined quantity of tobacco into the dosing tube and to a pouching apparatus using compressed air from the compressed air source.

2. The method of claim 1, further including conveying the predetermined quantity of moist smokeless tobacco using a tobacco feed drive.

3. The method of claim 1, further including supplying atomized water into the dosing chamber between successive repetitions of the ejecting step and subsequent placing step so as to remove residual moist smokeless tobacco contained therein.

4. The method of claim 1, further including sequentially delivering doses of the predetermined quantity of moist smokeless tobacco to the pouching apparatus through the dosing tube.

5. The method of claim 1, further including placing the predetermined quantity of moist smokeless tobacco in a pouch.

6. The method of claim 5, further including sealing the pouch to contain the moist smokeless tobacco therein and form an oral tobacco pouch product.

7. The method of claim 1, wherein the loading chamber is located in a dosing assembly comprising the movable element and a fixed element, said movable element movable between the retracted position and the closed position, said movable element defining the loading chamber and the dosing chamber wherein said movable element compacts said predetermined quantity of moist smokeless tobacco into said dosing chamber upon moving into said closed position and delivering compressed air to the dosing assembly so as to move the predetermined quantity of moist smokeless tobacco from the dosing chamber through the discharge opening to the pouching apparatus.

8. The method of claim 7, further including storing moist smokeless tobacco in a hopper prior to delivery to the dosing assembly.

9. The method of claim 8, further including delivering a predetermined quantity of moist smokeless tobacco via a tobacco feed drive system into the loading chamber of the dosing assembly.

10. The method of claim 7, further including transferring the predetermined quantity of moist smokeless tobacco through the port to the loading chamber using a twin screw feeder.

11. The method of claim 7, wherein a controller operates the dosing assembly.

12. The method of claim 7, wherein the movable element comprises a rotary dosing cam.

13. The method of claim 7, wherein the movable element comprises a reciprocable slide.

14. The method of claim 13, wherein an air cylinder is connected to the reciprocable slide and moves the reciprocable slide into the closed position.

15. A method of consistently and repetitively delivering predetermined amounts of moist smokeless tobacco from a source to a processing machine, comprising:

feeding a predetermined amount of said moist smokeless tobacco through a port and into a loading chamber defined between a movable element and a fixed element, said feeding including the step of positioning said movable element at a retracted position which does not block the port through which the predetermined quantity passes into the loading chamber and is in a spaced apart relation from said fixed element, said positioning said movable element at said retracted position including the step of opening said port;

urging said fed, predetermined amount of moist smokeless tobacco into a cylindrical dosing chamber defined between said movable element and a fixed element by moving said movable element from said retracted position after said feeding step to a closed position at which the port is blocked by the movable element and the movable element is adjacent said fixed element, whereat said movable element and said fixed element at least partially define said dosing chamber, said urging step including the step of compacting said fed, predetermined amount of moist smokeless tobacco in said dosing chamber so that it is retained in said dosing chamber adjacent a discharge orifice aligned with a dosing tube and the dosing chamber is in fluid communication with a source of compressed air; and discharging said compacted fed, predetermined amount of moist smokeless tobacco from said dosing chamber through said discharge orifice into the dosing tube and along a path to said processing machine using only compressed air from the source of compressed air.

16. The method of claim 15, wherein the movable element is a reciprocable slide and said moving said movable element from said retracted position to said closed position comprises moving the reciprocal slide horizontally.

17. The method of claim 16, wherein an air cylinder reciprocates said movable element between said retracted position and said closed position.

18. The method of claim 16, further including washing said dosing chamber with atomized water after said discharging step while said movable element is at said closed position.

19. The method of claim 15, wherein said movable element rotates between said retracted position and said closed position.

20. The method of claim 15, wherein said discharging step includes directing a pulse of compressed air through said discharge dosing chamber.

21. A method of consistently forming a pouch containing moist smokeless tobacco at a predetermined moisture content, said moist smokeless tobacco having a tendency to clump at said predetermined moisture content, said method comprising:

establishing a source of said moist smokeless tobacco essentially at said predetermined moisture content;

repetitively metering a predetermined quantity of said moist smokeless tobacco into a loading chamber and compacting the metered quantity of moist smokeless tobacco into a cylindrical dosing chamber formed by moving a movable element from an open position which does not block a port through which the predetermined quantity passes into the loading chamber to a closed position at which the port is blocked by the movable element and a discharge opening of the dosing chamber is aligned with a dosing tube and the dosing chamber is in fluid communication with a source of compressed air; and ejecting the predetermined quantity of moist smokeless tobacco through the dosing tube to a pouching apparatus by discharging compressed air from the source of compressed air through said dosing chamber after said compacting;

said establishing, said repetitively metering and compacting and said ejecting being undertaken in the absence of drying of said moist smokeless tobacco such that said moist smokeless tobacco remains essentially at said predetermined moisture content.

22. The method of claim 21, wherein said moist smokeless tobacco has a predetermined moisture content of about 30% or greater.

* * * * *